US010150322B1

(12) United States Patent
Dennis et al.

(10) Patent No.: US 10,150,322 B1
(45) Date of Patent: Dec. 11, 2018

(54) GREETING CARD WITH TOTE BAG

(71) Applicant: American Greetings Corporation, Cleveland, OH (US)

(72) Inventors: Erin Dennis, Lakewood, OH (US); Nicole Forrester, Cleveland, OH (US)

(73) Assignee: American Greetings Corporation, Cleveland, OH (US)

( * ) Notice: Subject to any disclaimer, the term of this patent is extended or adjusted under 35 U.S.C. 154(b) by 83 days.

(21) Appl. No.: 15/850,680

(22) Filed: Dec. 21, 2017

(51) Int. Cl.
*B42D 15/04* (2006.01)
*A45C 7/00* (2006.01)

(52) U.S. Cl.
CPC ..... *B42D 15/045* (2013.01); *A45C 7/0059* (2013.01)

(58) Field of Classification Search
CPC . B42D 15/045; G09F 1/00; G09F 1/08; G09F 1/04
See application file for complete search history.

(56) References Cited

U.S. PATENT DOCUMENTS 2,164,641 A * 7/1939 Davenport ..... A45C 7/0077 383/127
4,011,898 A * 3/1977 Hubbard ..... A45C 7/0077 150/107
4,434,889 A * 3/1984 Fery ..... B42D 15/08 206/216
5,251,743 A * 10/1993 Pulido ..... A45C 3/04 206/37.1
6,550,617 B1 * 4/2003 Elva ..... B42D 15/045 206/232
2006/0064906 A1 3/2006 Flemons
2014/0248004 A1 * 9/2014 Weinberg ..... A45C 7/0077 383/6
2015/0246751 A1 * 9/2015 Spivack ..... B65D 31/12 224/411

FOREIGN PATENT DOCUMENTS

DE 102006046118 4/2008

OTHER PUBLICATIONS

Abi Zimmerman, Purseonals Greeting Card Booth, https://www.flickr.com/photos/62840809@N06/5727913496/, May 14, 2011.*

* cited by examiner

*Primary Examiner* — Cassandra Davis
(74) *Attorney, Agent, or Firm* — Christine Flanagan

(57) ABSTRACT

A greeting card containing with a tote bag releasably attached thereto. The tote bag may be folded into a small pouch which is then attached to one or more panels of the greeting card. The tote may be of the reusable kind and may be removed and used by the recipient.

17 Claims, 3 Drawing Sheets

GREETING CARD WITH TOTE BAG

RELATED APPLICATIONS

There are no applications related to this application.

FIELD OF THE INVENTION

The present invention is in the field of social expression products. More specifically, the invention is directed to a greeting card.

SUMMARY OF THE INVENTION

In one embodiment of the present disclosure and related inventions, a greeting card contains a tote bag releaseably attached thereto. In other embodiments, the greeting card may be contained within a small pouch which is releasably attached to at least one panel of the greeting card. The greeting card may additionally include a protective sleeve or covering over the pouch and tote bag.

DETAILED DESCRIPTION OF PREFERRED AND ALTERNATE EMBODIMENTS

The present disclosure and related inventions include a greeting card 100 including a greeting card body 10 and an attached, reusable tote bag 12. The tote bag 12 is removably attached to the greeting card body 10 and can be removed and used long after discarding the greeting card body 10.

Figure 1:
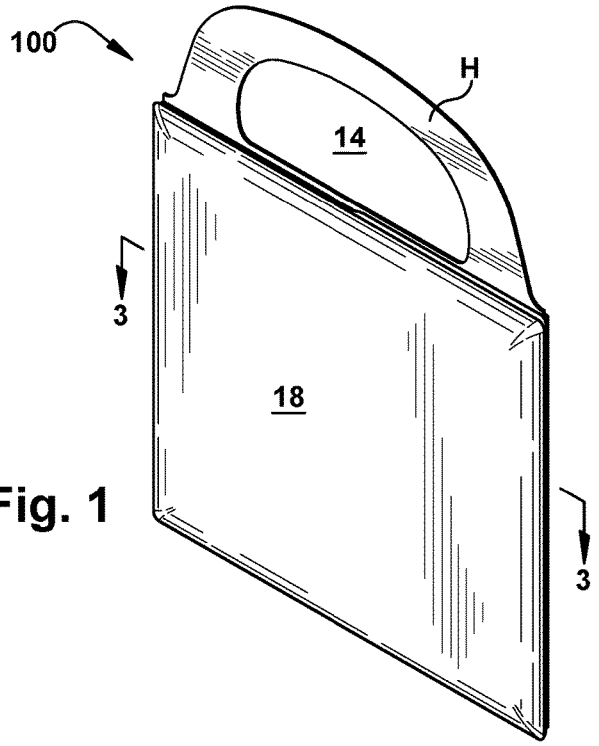
FIG. 1 is a front perspective view of the greeting card of the present invention, in a closed position.

The greeting card 100 includes a greeting card body 10 which contains one or more greeting card panels. In one embodiment, the greeting card panels are made of paperboard, although in other embodiments, the greeting card panels may be made of other materials such as paper, cardboard, plastic, or any other material. In one embodiment, the greeting card body 10 may contain four greeting card panels. A first greeting card panel 10A is attached to a second greeting card panel 10B along a first fold line F1. The second greeting card panel 10B is attached to a third greeting card panel 10C along a second fold line F2. The third greeting card panel 10C is attached to a fourth greeting card panel 10D along a third fold line F3. The greeting card panels 10A-D may be contiguous or may be separate panels attached along the three-fold lines F1-F3 via glue, tape, or any other attachment material or mechanism. Each greeting card panel 10A-D contains a front surface and a rear surface opposite the front surface. The rear surface of the second and third greeting card panels 10B, 10C are attached to one another to form a single, center panel CP. Combining the second and third panels 10B, 10C in this way creates a more sturdy and thicker center panel CP. In other embodiments, the second and third panels 10B, 10C may be replaced by a single panel. A tote bag 12, discussed in detail below, is enclosed within a pouch 18 which is to the first greeting card panel 10A and serves as the front or cover panel of the greeting card 100, as shown in FIG. 1. The rear surface of the first greeting card panel 10A is attached to the front surface of the second greeting card panel 10B. The front surface of the third greeting card panel 10C (which is attached to the second greeting card panel 10B) serves as the inside left panel of the greeting card 100. The front surface of the fourth greeting card panel 10D serves as the inside right panel of the greeting card 10 and the rear surface of the fourth greeting card panel 10D serves as the back panel of the greeting card 10. Given that the first, second and third panels 10A, 10B, 10C of the greeting card 10 are attached, in operation, the greeting card operates as a two-panel greeting card with the first, second and third panels 10A, 10B, 10C being the left side of the greeting card and the fourth panel 10D being the right side of the greeting card. The second and third panels 10B, 10C of the greeting card contain an opening 14 thereon in an upper or top portion thereof. The lower portion is substantially square shaped. The first and fourth greeting card panels 10A, 10D are substantially square shaped. While the greeting card panels 10A-D have been described herein and shown in the drawings as being substantially square shaped, other shapes may be used. The various greeting card panels may all be shaped the same or one or more panels may be shaped differently from the other panels. The opening or aperture 14 on the second and third greeting card panels 10B, 10C is intended to create a handle H such that the greeting card itself resembles a tote bag, purse, briefcase, or other such container. Each of the greeting card panels 10A-D may contain printing thereon which may be text sentiment, photos, drawings, pictures, or any other printed matter.

Figure 5:
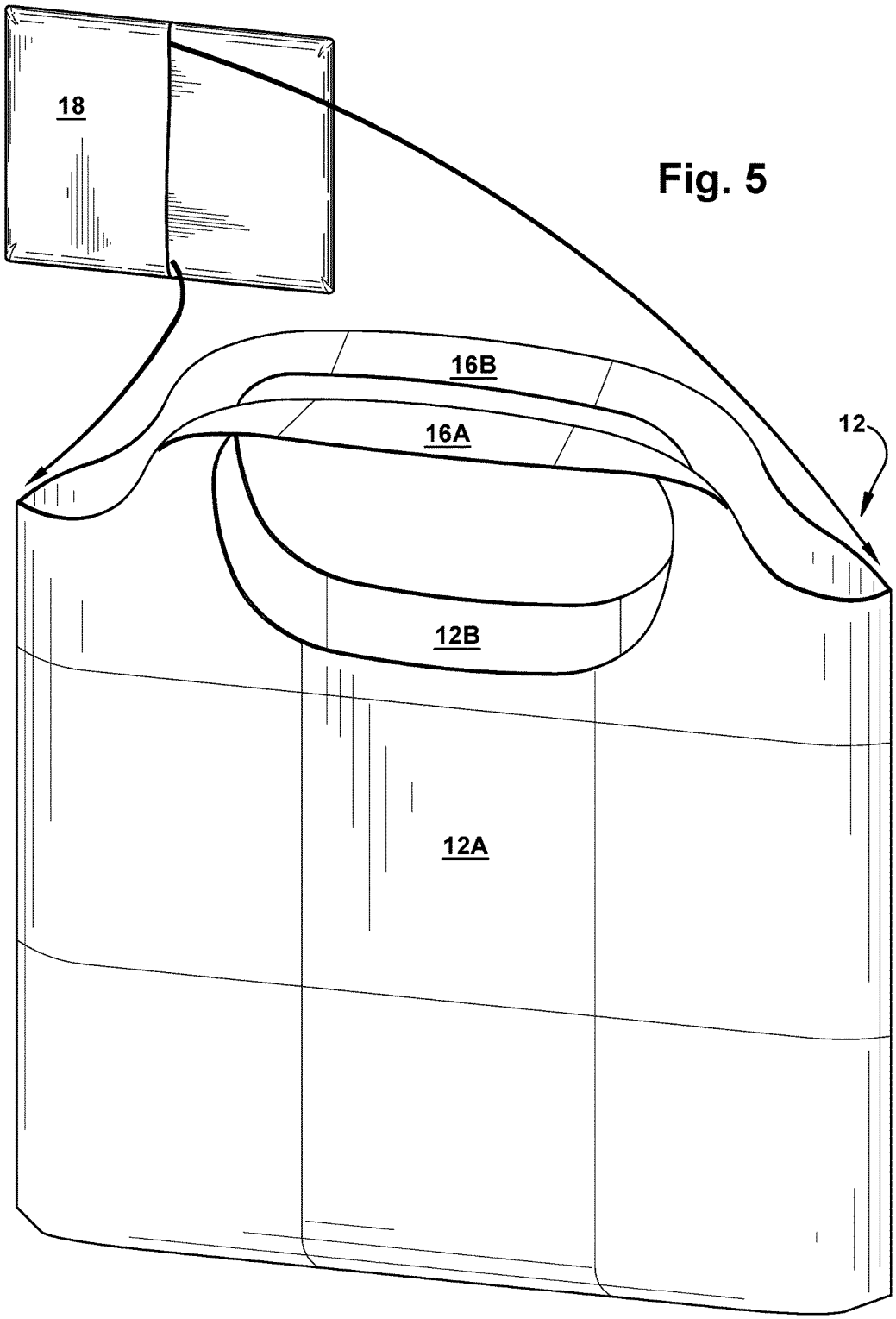
FIG. 5 is a front perspective view of the tote bag attached to the greeting card of FIG. 1.

A tote bag 12 (contained within a pouch 18) is removably attached to the first panel 10A of the greeting card. The term "tote bag" is intended to cover shopping bags, grocery bags, pouches, string bags, sacks, or any other flexible containers. The tote bag 12 may be made of natural or synthetic material. Such materials may include, but are not limited to: cloth, fiber, canvas, jute, hemp, cotton, paper, plastic, polypropylene, etc. The material may be recyclable and/or biodegradable. The tote bag 12 may be of any color or colors and may contain printing thereon, including, but not limited to text, photos, drawings, pictures, or any other printable material. In one embodiment, the tote bag 12 may be a single use bag, such as a plastic or paper bag, and in other embodiments, the tote bag 12 is a sturdier and more durable reusable bag, such as a reusable shopping bag. In one embodiment, the tote bag 12 may contain a front side 12A, a back side 12B, a bottom or floor 12C and an open top. Each of the front and back panels 12A, 12B of the bag 12 may contain opposing right and left straps 16A, 16B attached to or integral with an upper surface or side thereof, as shown in FIG. 5. The right and left straps 16A, 16B are sewn together or otherwise attached to create an opening through which a user's arm may be inserted to carry the tote bag 12 on his/her shoulder. In another embodiment, the right and left straps 16A, 16B are integral and do not need to be sewn or otherwise attached. While the tote bag 12 has been described herein and shown in the figures with respect to a particular embodiment, other embodiments may differ in structure however, any type and structure of tote bag is considered to be within the scope of the present invention.

Figure 2:
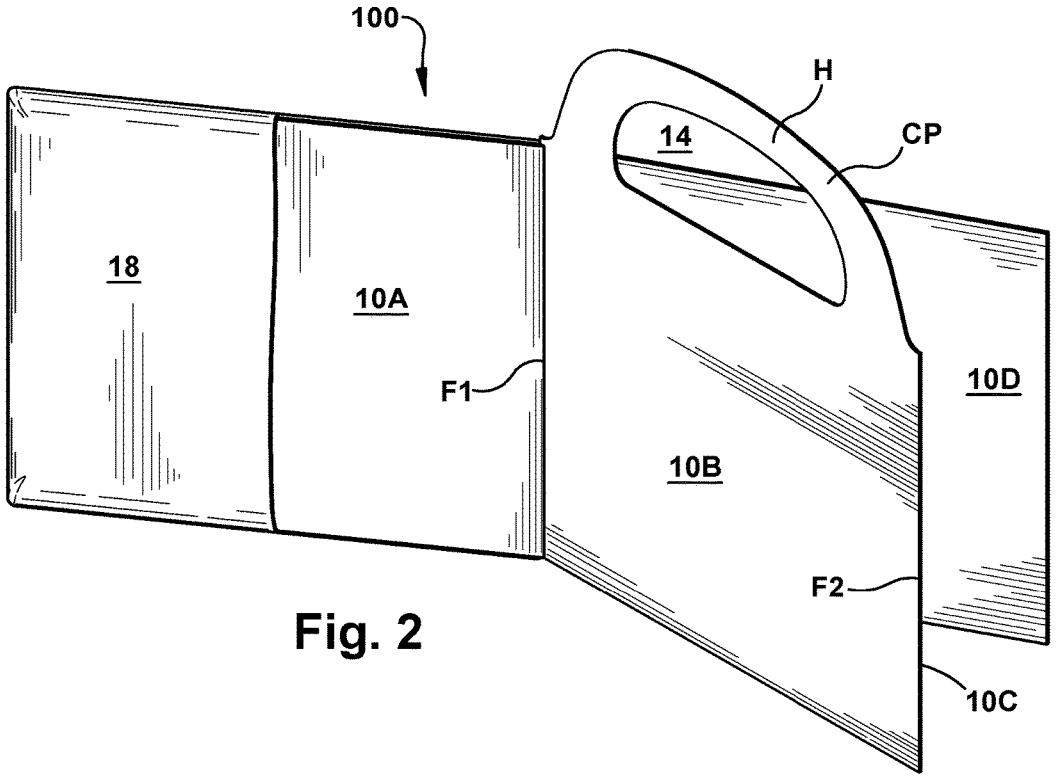
FIG. 2 is a front perspective view of the greeting card of FIG. 1, in an open position.
Figure 3:
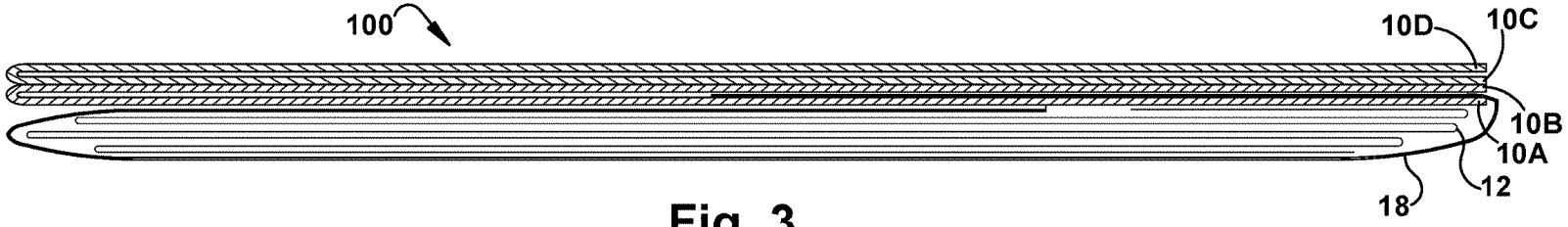
FIG. 3 is a cross-sectional view of the greeting card of FIG. 1, from the perspective of arrows 3-3.
Figure 4:
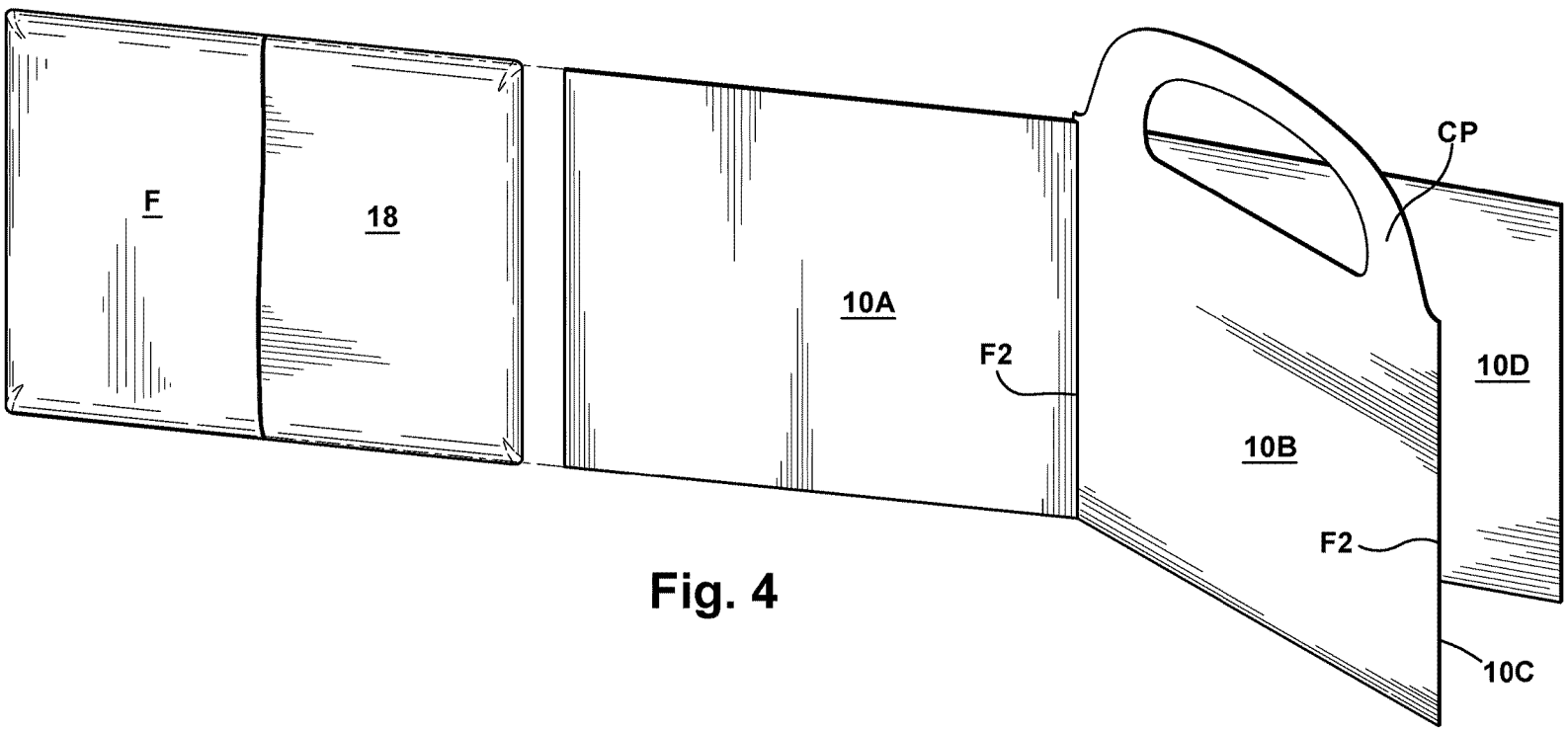
FIG. 4 is an exploded view of the greeting card of FIG. 1.

In one embodiment, the tote bag 12 may be folded and placed into a smaller bag, pocket, or container (referred to hereafter as "pouch") 18, as shown in the figures. The pouch 18 may be made of the same or different material than the tote bag 12. The pouch 18 may contain a substantially square front panel, a rear panel opposite the front panel, a right side perimeter edge, a left side perimeter edge, opposite the right side perimeter edge, a bottom or lower perimeter edge and a top or upper perimeter edge. The front and rear panels are sewn together or otherwise attached along the right, left and bottom or lower perimeter edge with the top or upper perimeter edge being open for insertion and removal of the tote bag 12. The pouch 18 may additionally contain a flap F which is folded over the front or rear panel along the open-sided perimeter edge. The flap F is also sewn into or attached to the right and left perimeter edges. The flap F can be folded over the open edge (top or upper perimeter) to create a closed pouch or cavity therein. The pouch 18 (with tote bag 12 contained therein) is attached to the first greeting card panel 10A. In one embodiment, the pouch 18 (with tote bag 12 contained therein) may be contained within a polybag or other type of protective sleeve. The polybag serves to protect the pouch 18 and tote bag 12 from harm during shipping and while on display at retail. In other embodiments, the polybag may be replaced by any other type of protective covering or material or may be omitted. In one embodiment, the size and shape of the pouch 18 and polybag are generally the same as the first greeting card panel 10A, such that the pouch 18 (with tote back 12 contained therein) sits directly atop or over the first greeting card panel 10A, as shown in FIGS. 2, 3 and 4. Once the pouch 18 and tote bag 12 are contained within the polybag, the right side of the first greeting card panel 10A (opposite the first fold line F1) is inserted into the space between the front or rear panel of the pouch 18 and the flap F, as shown in FIG. 2 and at least a portion of the rear surface of the polybag is attached via glue or other attachment material or mechanism, to the front surface of the second greeting card panel 10B such that the first, second and third greeting card panels 10A-10C are connected and move as a single unit. The greeting card is opened and closed by moving or pivoting the first, second and third greeting card panels 10A-10C (as one unit) about the third fold line F3 away from or towards the fourth greeting card panel 10D. When a recipient receives the greeting card, he/she can remove the tote bag 12 from the pouch 18 and polybag before discarding the greeting card.

In other embodiments, the greeting card may contain a gift card. The gift card may be attached directly to the greeting card body or may be attached to the pouch or the tote bag. The gift card and tote bag may be themed such that the tote bag contains information or advertising directed to a particular retailer and the gift card is redeemable at the same retailer.

In other embodiments, the greeting card may contain one or more special effects such as audio, lights or motor movement of one or more mobile objects attached to the greeting card. In these embodiments, the greeting card would additionally need electronic components contained within the greeting card body to produce said special effects.

The foregoing embodiments of the present invention have been presented for the purposes of illustration and description. These descriptions and embodiments are not intended to be exhaustive or to limit the invention to the precise form disclosed, and obviously many modifications and variations are possible in light of the above disclosure. The embodiments were chosen and described in order to best explain the principle of the invention and its practical applications to thereby enable others skilled in the art to best utilize the invention in its various embodiments and with various modifications as are suited to the particular use contemplated. It is intended that the invention be defined by the following claims.

The invention claimed is:

1. A greeting card comprising:
a greeting card body;
a pouch releasably attached to the greeting card body;
a tote bag contained within the pouch;
wherein at least one panel of the greeting card body is at least partially inserted into the pouch.

2. The greeting card of claim 1, wherein the tote bag contains handles which are integral with the tote bag.

3. The greeting card of claim 1, wherein the pouch and tote bag are attached to a front surface of the greeting card body.

4. The greeting card of claim 1, wherein the pouch has one open side.

5. The greeting card of claim 1, wherein the tote bag is reusable.

6. The greeting card of claim 1, wherein the greeting card body is shaped to resemble a tote bag.

7. The greeting card of claim 1, wherein the tote bag is folded into a substantially square shape.

8. A greeting card comprising:
a greeting card body;
a pouch releasably attached to the greeting card body, the pouch having a flap thereon;
a tote bag contained within the pouch;
wherein a portion of the greeting card body is inserted beneath the flap on the pouch.

9. The greeting card of claim 8, wherein the greeting card body contains a handle thereon.

10. The greeting card of claim 8, wherein the greeting card is shaped to resemble a tote bag.

11. The greeting card of claim 8, wherein the pouch is attached to a front surface of the greeting card body.

12. The greeting card of claim 8, wherein the tote bag is reusable.

13. The greeting card of claim 8, wherein the tote bag contains straps or handles.

14. The greeting card of claim 8, wherein the pouch and the tote bag are made of the same material.

15. A greeting card comprising:
a greeting card body;
a pocket releasably attached to the greeting card body, the pocket comprising an internal cavity, an opening along at least one edge thereof, and a flap, wherein the flap can be folded over the opening to close the pocket; and
a folded tote bag contained within the pocket;
wherein the flap on the pocket is inserted over at least a portion of the greeting card body.

16. The greeting card of claim 15, wherein the folded tote bag or pouch is visible from the front surface of the greeting card.

17. The greeting card of claim 15, wherein the folded tote bag is reusable.

* * * * *